US011635006B2

(12) United States Patent
Akita et al.

(10) Patent No.: US 11,635,006 B2
(45) Date of Patent: Apr. 25, 2023

(54) BLOW-BY GAS RECIRCULATION DEVICE

(71) Applicant: KUBOTA Corporation, Osaka (JP)

(72) Inventors: Mitsuhiro Akita, Sakai (JP); Kazuyuki Chuma, Sakai (JP); Kohei Sawada, Sakai (JP); Yukimasa Kabe, Sakai (JP); Satoshi Inayama, Sakai (JP); Junya Ikai, Sakai (JP)

(73) Assignee: KUBOTA CORPORATION, Osaka (JP)

( * ) Notice: Subject to any disclaimer, the term of this patent is extended or adjusted under 35 U.S.C. 154(b) by 0 days.

(21) Appl. No.: 17/616,262

(22) PCT Filed: Apr. 14, 2020

(86) PCT No.: PCT/JP2020/016470

§ 371 (c)(1),
(2) Date: Dec. 3, 2021

(87) PCT Pub. No.: WO2020/250566

PCT Pub. Date: Dec. 17, 2020

(65) Prior Publication Data

US 2022/0251986 A1 Aug. 11, 2022

(30) Foreign Application Priority Data

Jun. 12, 2019 (JP) ..... JP2019-109378

(51) Int. Cl.
*F01M 13/04* (2006.01)
*F01M 13/00* (2006.01)

(52) U.S. Cl.
CPC .... *F01M 13/0416* (2013.01); *F01M 13/0011* (2013.01); *F01M 2013/0438* (2013.01)

(58) Field of Classification Search
CPC ..... F01M 13/04; F01M 2013/0438; F01M 2013/0044; F01M 13/00; F01M 2013/0016; F01M 13/0033; F01M 2013/0038; F01M 2013/005; F01M 2013/0083;

(Continued)

(56) References Cited

FOREIGN PATENT DOCUMENTS

| | | | | |
|---|---|---|---|---|
| CN | 201041060 Y | * | 3/2008 | |
| CN | 103987928 A | * | 8/2014 | ..... F01M 13/04 |
| CN | 105715326 A | * | 6/2016 | ..... F01M 13/04 |

(Continued)

*Primary Examiner* — George C Jin
*Assistant Examiner* — Teuta B Holbrook
(74) *Attorney, Agent, or Firm* — Panitch Schwarze Belisario & Nadel LLP

(57) ABSTRACT

A blow-by gas recirculation device that, while having a structure in which a passage for blow-by gas is in a head cover and an oil separator, an increase in size of an engine is suppressed and the risk of the freezing is mostly avoided by shortening the length of an external pipe for the blow-by gas. Therefore, the blow-by gas recirculation device guides blow-by gas from a crankcase to an intake passage through an in-cover gas passage formed inside a head cover. An oil separator that traps and removes oil from the blow-by gas is attached to the inside of the head cover. A pressure regulating valve is provided on the outlet side of the in-cover gas passage in the head cover. A separator outlet, which is an outlet for the blow-by gas in the oil separator, is overlapped on a blow-by gas inlet portion of the pressure regulating valve.

20 Claims, 11 Drawing Sheets

(58) Field of Classification Search
CPC ..... F01M 13/0405; F01M 13/0416; F01M 2013/0433; F01M 2013/0461
See application file for complete search history.

(56) References Cited

FOREIGN PATENT DOCUMENTS

| | | | | | |
|---|---|---|---|---|---|
| CN | 106246286 | A | * | 12/2016 | ..... F01M 13/00 |
| CN | 107023348 | A | * | 8/2017 | ..... F01M 13/0405 |
| CN | 107152324 | A | * | 9/2017 | ..... F01M 13/04 |
| CN | 107939479 | A | * | 4/2018 | ..... F01M 13/04 |
| CN | 109113833 | A | * | 1/2019 | ..... F01M 13/04 |
| CN | 109236416 | A | * | 1/2019 | ..... F01M 13/04 |
| DE | 102014013714 | A1 | * | 3/2016 | ..... F01M 13/02 |
| EP | 1959105 | A1 | * | 8/2008 | ..... F01M 13/022 |
| EP | 2090760 | A2 | * | 8/2009 | ..... F01M 13/0416 |
| JP | 2018-035787 | A | | 3/2018 | |
| KR | 1544727 | B1 | * | 8/2015 | ..... B01D 45/08 |

* cited by examiner (A)

(B)

BLOW-BY GAS RECIRCULATION DEVICE

CROSS-REFERENCE TO RELATED APPLICATIONS

This application is a Section 371 of International Application No. PCT/JP2020/016470, filed Apr. 14, 2020, which was published in the Japanese language on Dec. 17, 2020, under International Publication No. WO 2020/250566 A1, which claims priority under 35 U.S.C. § 119(b) to Japanese Application No. 2019-109378, filed Jun. 12, 2019, the disclosures of each of which are incorporated herein by reference.

TECHNICAL FIELD

The present invention relates to a blow-by gas recirculation device to be mounted on: an industrial engine to be used in an agricultural machine or a construction machine; an automobile engine; or the like.

BACKGROUND ART

Many industrial diesel engines and the like have a structure including a blow-by gas recirculation device configured to allow blow-by gas to pass through the inside of a cylinder head cover (hereinafter, abbreviated as a head cover) and then return to an intake path.

In the structure in which blow-by gas is allowed to pass through the inside of the head cover and then returned to the intake passage, a gas passage is generally provided on the upper side of a valve mechanism in the head cover. Since the gas passage inside the head cover tends to be a flat passage that is vertically narrow, an oil separator for trapping oil components from the blow-by gas is generally provided outside the head cover as a dedicated part (e.g., Patent Document 1).

In the structure in which the oil separator is disposed on the side of a cylinder block, there is almost no limitation on space as inside the head cover, so that there is an advantage that the oil separator can have a sufficient capacity. However, the oil separator, which is a dedicated part, is added as an auxiliary machine of the engine, so that there arise the following problems.

That is, the size (bulk) of the entire engine tends to increase as much as the oil separator is attached. In addition, since the gas passage from the head cover to the intake passage, that is, an external pipe becomes large in length, the risk that the moisture contained in the blow-by gas may freeze in cold weather increases.

PRIOR ART DOCUMENT

Patent Document

Patent Document 1: Japanese Patent Application Laid-open No. 2018-35787

SUMMARY OF THE INVENTION

Problems to be Solved by the Invention

An object of the present invention is to provide a blow-by gas recirculation device that, while having a configuration in which a passage for blow-by gas is provided in a head cover and an oil separator is also provided, is improved, by devising a structure, in that an increase in size of an engine is suppressed and the risk of the freezing is avoided as much as possible by shortening the length of an external pipe for the blow-by gas.

Solutions to the Problems

A blow-by gas recirculation device according to the present invention is characterized by being configured to guide blow-by gas from a crankcase to an intake passage through an in-cover gas passage formed inside a head cover, in which an oil separator that traps and removes oil from the blow-by gas is attached to the inside of the head cover, a pressure regulating valve is provided on an outlet side of the in-cover gas passage in the head cover, and a separator outlet, which is an outlet for the blow-by gas in the oil separator, is overlapped on a blow-by gas inlet portion of the pressure regulating valve.

It is preferable that the pressure regulating valve is disposed in a gas outlet portion of the in-cover gas passage with respect to the head cover. Furthermore, it is preferable that the pressure regulating valve is a diaphragm valve and a cover lid that enables assembly and removal of a diaphragm is detachably attached to the head cover.

It is preferable that the oil separator includes a separator inlet through which the blow-by gas is introduced, an oil filter, an oil dropping portion, and the separator outlet through which the blow-by gas is discharged. It is preferable that the oil filter has an impactor structure including a nozzle and a collision plate. It is more preferable that the oil dropping portion protrudes toward a gap portion of a valve mechanism provided inside the head cover.

It is preferable that: a check valve that allows a downward movement of the oil and prevents an upward movement of the oil is provided in a lower end portion of the oil dropping portion; and the oil separator is formed in a long shape along a longitudinal direction of the head cover.

Effects of the Invention

According to the present invention, the oil separator is built into (housed in) the head cover, so that the bulk of the entire engine can be made smaller than a case where an oil separator is disposed outside the head cover as a dedicated part. Moreover, an external pipe for the blow-by gas from the head cover to the oil separator can be omitted, so that there is an advantage that the risk that the moisture in the blow-by gas may freeze in the external pipe in cold weather or the like is avoided.

Further, the blow-by gas outlet of the oil separator is overlapped on the blow-by gas inlet portion of the pressure regulating valve provided on the blow-by gas outlet side of the head cover, so that a path that connects the separator and the pressure regulating valve becomes unnecessary, and a space necessary for disposing the separator and the pressure regulating valve, the space being minimized as much as possible, can be provided in the head cover.

As a result, it is configured such that the oil separator is provided in the head cover in a state of being overlapped on the passage for the blow-by gas and the pressure regulating valve, so that an increase in the size of an engine can be suppressed and the risk of the freezing can be avoided as much as possible by shortening the length of the external pipe for the blow-by gas, whereby an improved blow-by gas recirculation device can be provided.

BRIEF DESCRIPTION OF THE DRAWINGS

FIG. 5 is a plan view of the cylinder head cover and the like.

EMBODIMENTS OF THE INVENTION

Figure 1:
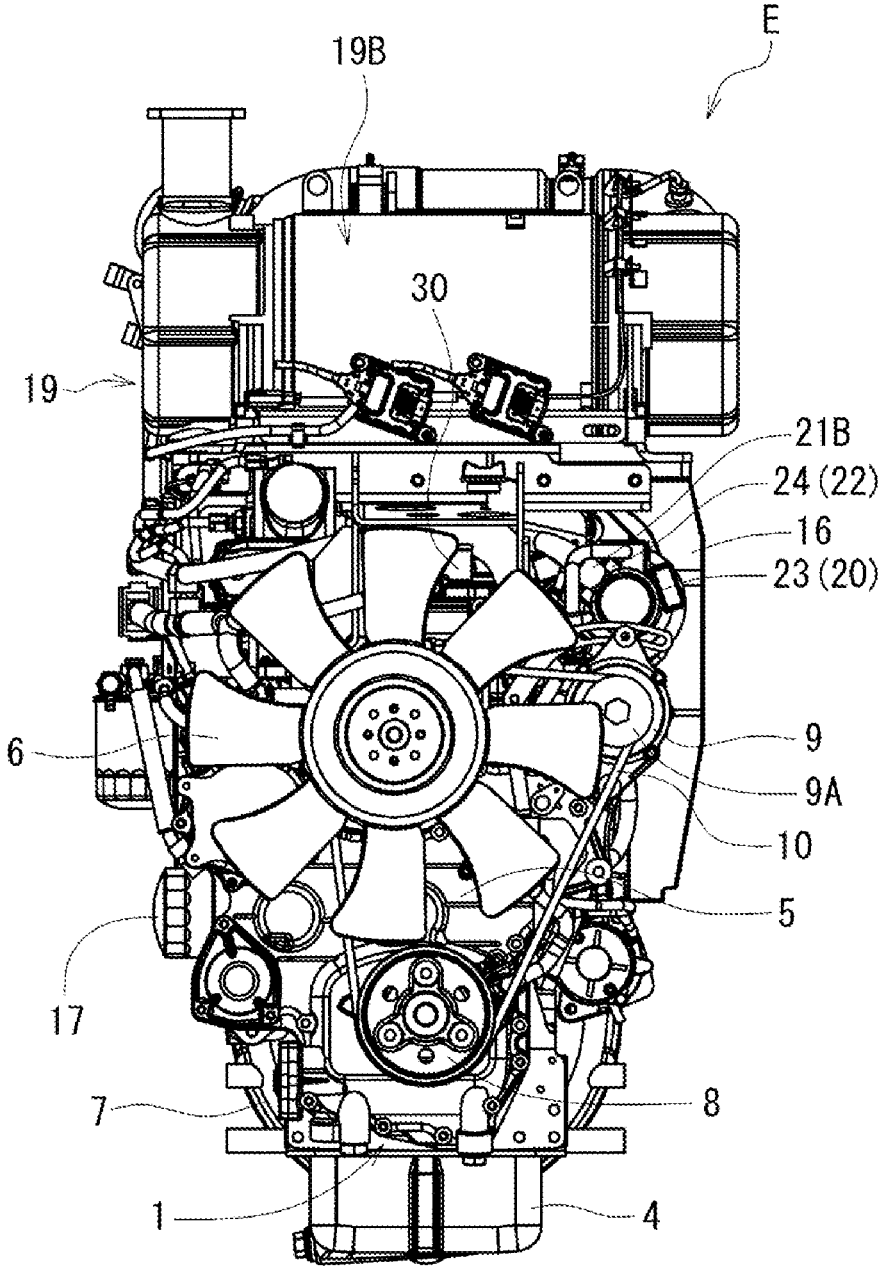
FIG. 1 is a front view of an industrial diesel engine.

Hereinafter, an embodiment of a blow-by gas recirculation device according to the present invention, when applied to an industrial diesel engine, will be described with reference to the drawings.

In a diesel engine E to be applied to industrial machines such as agricultural machines and construction machines, a cylinder head 2 is assembled on a cylinder block 1, a cylinder head cover (hereinafter, abbreviated as a "head cover") 3 is assembled on the cylinder head 2, and an oil pan 4 is assembled under the cylinder block 1, as illustrated in FIGS. 1 to 4.

A transmission case 5 is assembled to a front end portion of the cylinder block 1, an engine cooling fan 6 is disposed in a front portion of the transmission case 5, and a flywheel housing 7 is disposed in a rear portion of the cylinder block 1. The upper half portion of the cylinder block 1 is formed in a cylinder 1A, and the lower half portion is formed in a crankcase 1B.

A drive pulley 8 to be attached to a shaft end of a crankshaft (not illustrated), a fan pulley 6A for driving the engine cooling fan 6, a transmission belt 10 extending over a passive pulley 9A of a dynamo (alternator) 9, a water flange 30, and the like are mounted on a front portion of the engine E. An exhaust manifold 11, a supercharger 12, a starter 13, an EGR cooler 14, and the like are mounted on the left side of the engine E. An intake manifold 15, an oil filter 17, and the like are mounted on the right side of the engine E. A compressor downstream suction passage (secondary air passage) 18 (see FIG. 2) is disposed in an upper portion of the engine E.

An exhaust gas treatment device 19 is provided in an upper portion and a rear portion of the engine E. The exhaust gas treatment device 19 has an exhaust gas primary treatment device (DPF, etc.) 19A disposed in an upper portion of the flywheel housing 7 in the rear portion of the engine E, and an exhaust gas secondary treatment device (SCR, DOC, etc.) 19B disposed close to the rear portion of the head cover 3 in the upper portion of the engine E. The exhaust gas treatment device 19 is supported by a mounting frame 16 bolted to the cylinder block 1.

An intake passage a is a general term including a compressor upstream suction passage 20, the compressor downstream suction passage 18, and the intake manifold 15. The compressor upstream suction passage 20 is the intake passage a formed of a pipe connecting an air cleaner (not illustrated) and a compressor housing 12A of the supercharger (turbocharger) 12. The compressor downstream suction passage 18 is the intake passage a formed of a pipe connecting the compressor housing 12A and the intake manifold 15.

As illustrated in FIGS. 1 to 3 and FIG. 4(A), a blow-by gas recirculation device A that returns blow-by gas in the crankcase 1B to the intake passage a by using a blow-by gas passage w including an in-cover gas passage 3A (see FIG. 5) formed inside the head cover 3 is mounted on the engine E. The blow-by gas passage w has a gas duct 21 connecting the upper left side of the head cover 3 and the compressor upstream suction passage 20. The gas duct 21 is formed in a curved pipeline connecting a blow-by gas outlet (not illustrated) of the head cover 3 and a straight pipe 23.

As illustrated in FIGS. 1 to 3 and FIG. 4(A), the compressor upstream suction passage 20 includes a connecting pipe 29 externally fitted to an inlet cylinder (not illustrated) of the compressor housing 12A, the straight pipe 23 internally fitted and connected to the connecting pipe 29, and an air pipe (not illustrated) connecting the straight pipe 23 and the air cleaner (not illustrated). In the straight pipe 23, an inrush pipe (not illustrated) serving as a terminal portion of the blow-by gas passage w is formed in a laterally branched shape, and a heating mechanism 22 capable of warming the inrush pipe portion in the straight pipe 23 by using cooling water r is integrally provided.

Figure 5:
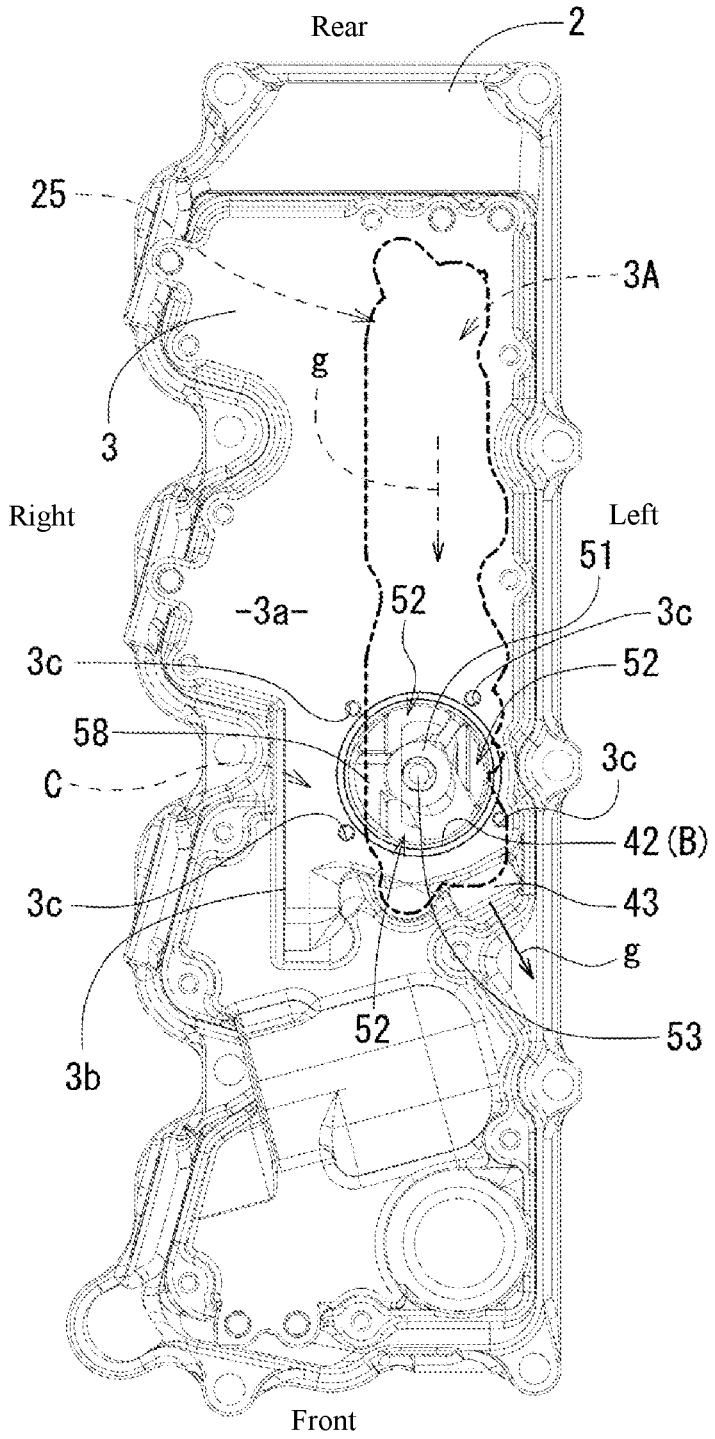
Figure 8:
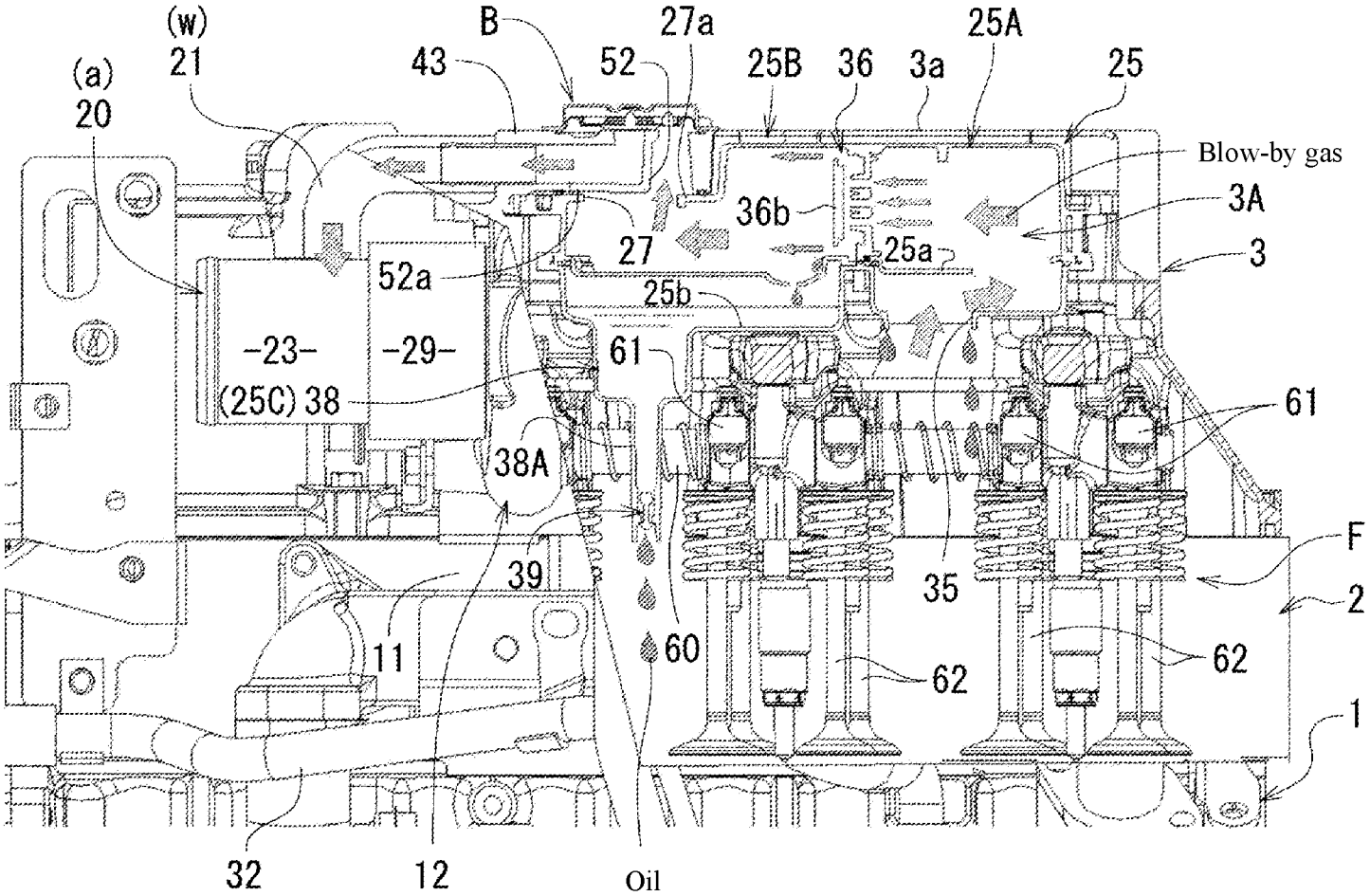
FIG. 8 is a partially cutaway side view illustrating a structure near a cylinder head and a head cover.

Next, the configuration of the portion of the head cover 3 in the blow-by gas recirculation device A will be described. As illustrated in FIGS. 5 and 8, the in-cover gas passage 3A mainly includes an oil separator 25 and a positive crankcase ventilation (PCV) valve (an example of a pressure regulating valve) B housed in an upper portion of the head cover 3 covering a valve mechanism F. The oil separator 25 that traps and removes oil from the blow-by gas and the PCV valve B provided in a gas outlet portion (an example of the "outlet side of the blow-by gas passage") in the head cover 3 are configured such that a separator outlet 27, which is an outlet for the blow-by gas in the oil separator 25, is overlapped on a blow-by gas inlet portion 52 of the PCV valve B.

As illustrated in FIGS. 8 to 11, the oil separator 25 has, in the head cover 3, an outer shell shape similar to an inner upper portion of the head cover 3 so as to be fitted into a space portion formed in a vertical clearance between a top wall 3*a* and the valve mechanism F without a gap (or with a small gap). The oil separator 25 has a separator inlet 35 that opens downward in the rear portion thereof, an oil filter 36 for trapping oil, a droplet collecting portion 37 that collects the trapped oil and drops them from a through hole 37*a*, and a downward protrusion (an example of an oil dropping portion) 38 that drops the collected oil into the engine. The separator outlet 27 is a substantially D-shaped hole (see FIG. 11) located above the downward protrusion 38.

As illustrated in FIGS. 8 to 11, the oil separator 25 is formed in a long shape along the longitudinal direction (front-rear direction) of the head cover 3, and can be divided into a separator rear portion 25A having the separator inlet 35, a separator middle portion 25B having the droplet collecting portion 37, and a separator front portion 25C having the separator outlet 27. The oil filter 36 is located at a boundary between the separator rear portion 25A and the separator middle portion 25B, and the downward protrusion 38 is formed in a lower portion of the separator front portion 25C.

The separator rear portion 25A is provided with a plate-shaped wall 25*a* protruding rearward in a horizontal posture on the upper side of the separator inlet 35 located in the front portion of the separator rear portion 25A. Therefore, it is configured such that the blow-by gas that has entered from the separator inlet 35 is once detoured backward and then moved toward the oil filter 36 located in the upper front portion.

The oil filter 36 is configured to have an impactor structure including a plurality of nozzles 36*a* vertically lined in a horizontal posture and a collision plate 36*b* in a vertical posture disposed in front of the nozzles. The blow-by gas is accelerated by passing through the nozzle 36*a*, and when the accelerated blow-by gas vigorously collides with the collision plate 36*b*, the oil contained in the blow-by gas is separated from the gas and dropped. Note that an orifice or a small diameter portion having a constant diameter may be adopted instead of the nozzle 36*a*, and in short, a means (passage) for increasing the speed of the blow-by gas may be adopted. These (nozzle, orifice, small diameter portion) may be collectively expressed as a speed increase path.

The separator middle portion 25B is a portion where the oil that is trapped by the oil filter 36 and drops is dropped from the droplet collecting portion 37 to a shallow bottom wall. The separator middle portion 25B is configured such that the oil that hits a wall 25*c* above the boundary with the separator front portion 25C and drops can also be guided to the droplet collecting portion 37. The oil that has dropped from the droplet collecting portion 37 can be stored on a shallow bottom wall 25*b* leading to the downward protrusion.

The separator front portion 25C leading to the separator middle portion 25B is provided with the separator outlet 27 in the upper portion, the downward protrusion 38 in the lower portion, and a partition wall 25*d* for forming the droplet collecting portion 37 in the vertical middle. In the separator front portion 25C, the separator outlet 27 is located at the highest position, and the height position of the upper surface (peripheral portion 27*a* described later) of a separator outlet 27*d* is set to be lower than the height positions of the upper surface of the separator rear portion 25A and the upper surface of the separator middle portion 25B, the height positions being the same as each other, for convenience in disposing the pressure regulating valve B.

Figure 9:
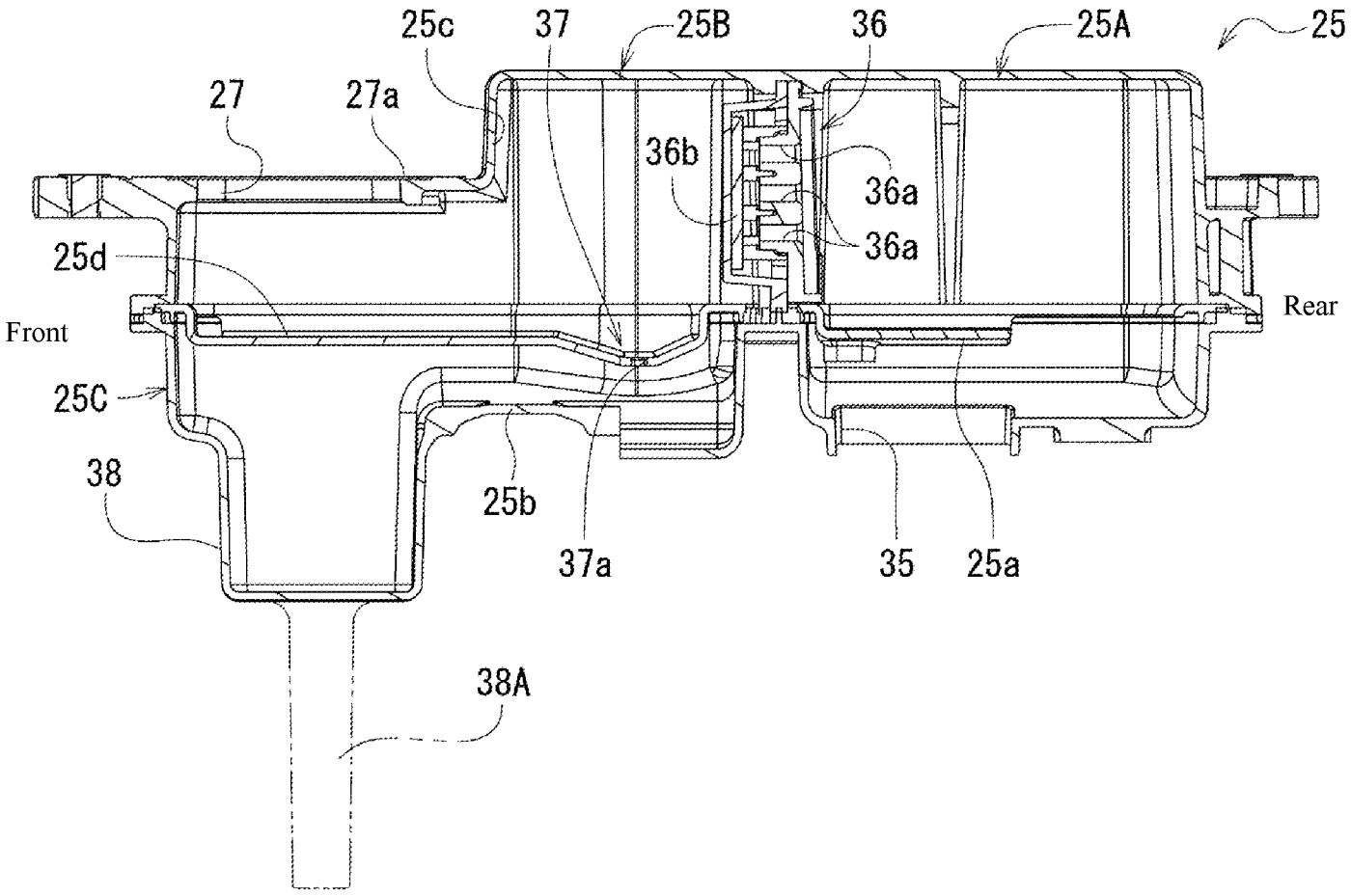
FIG. 9 is a cross-sectional view illustrating the structure of an oil separator as viewed from the side.
Figure 10:
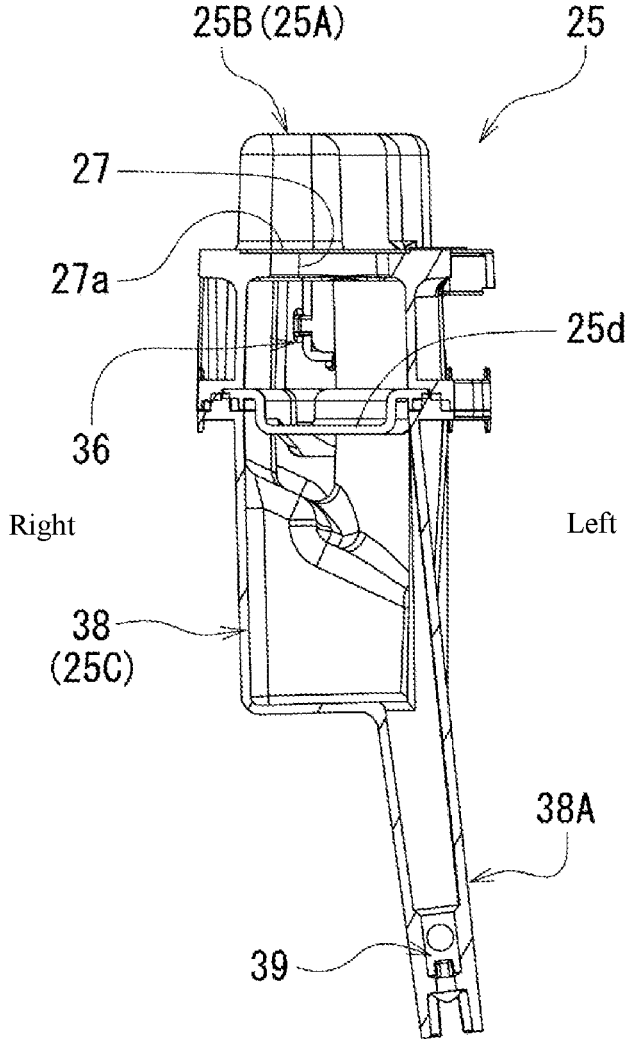
FIG. 10 is a front view of the oil separator.
Figure 11:
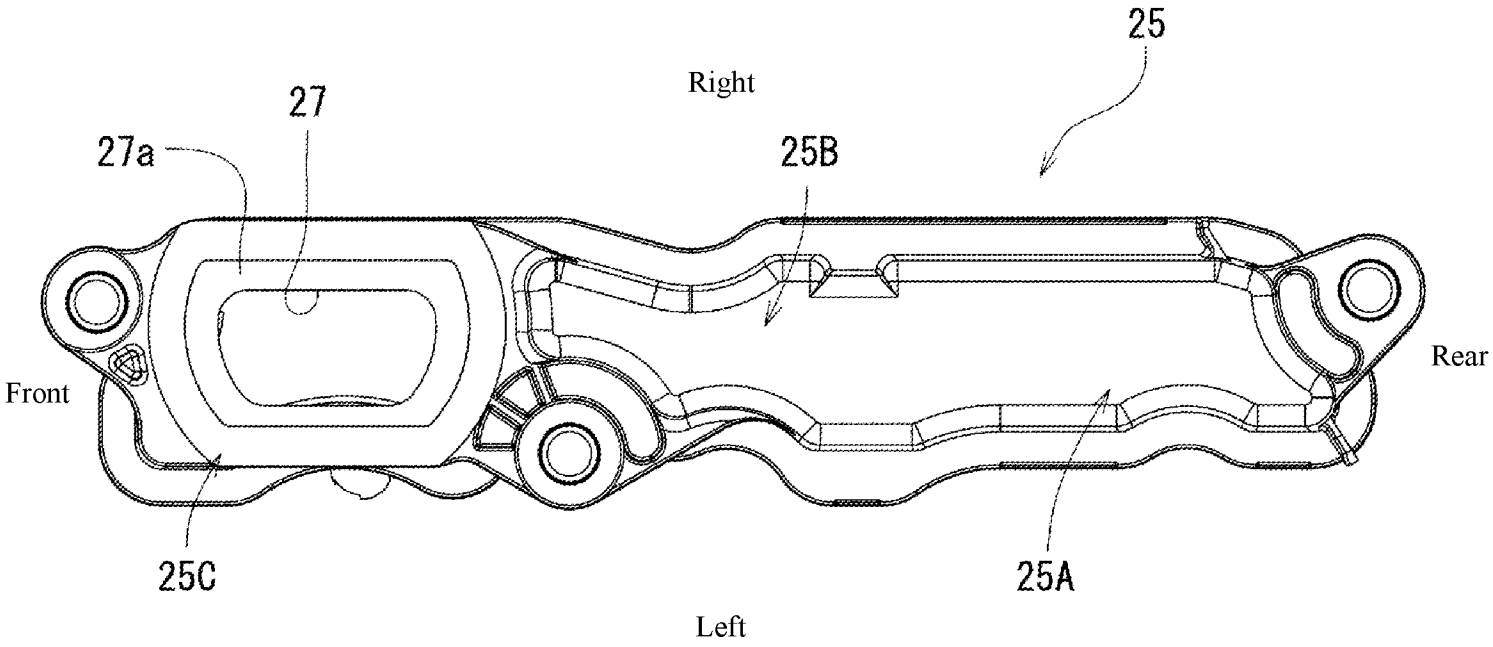
FIG. 11 is a plan view of the oil separator.

As illustrated in FIGS. 8 to 10, an extension protrusion 38A further protruding downward is formed in the downward protrusion 38, and a check valve 39 is provided below the extension protrusion. The oil dropped from the droplet collecting portion 37 can be stored in the downward protrusion 38 to some extent, and is returned into the engine from the lower end of the extension protrusion 38A through the check valve 39. The valve mechanism F includes functional parts such as a camshaft 60, a rocker arm 61, and a supply/discharge valve 62, and the downward protrusion 38 is provided to protrude toward a gap portion avoiding these functional parts.

As illustrated in FIG. 8, a peripheral portion 52*a* of a surrounding space portion 52, which is the blow-by gas inlet portion 52 of the pressure regulating valve B, and the peripheral portion 27*a* of the separator outlet 27 are in vertical contact with each other. As a result, the surrounding space portion 52 and the separator outlet 27 are configured to communicate with each other. Therefore, in the head cover 3, the blow-by gas that has entered the oil separator 25 from the separator inlet 35 flows in the order of the oil filter 36, the separator outlet 27, the pressure regulating valve B, and a gas outlet portion 43. In addition, the oil trapped by the oil separator 25 is dropped into the engine from the extension projection 38A, but may be dropped from the separator inlet 35.

Figure 4:
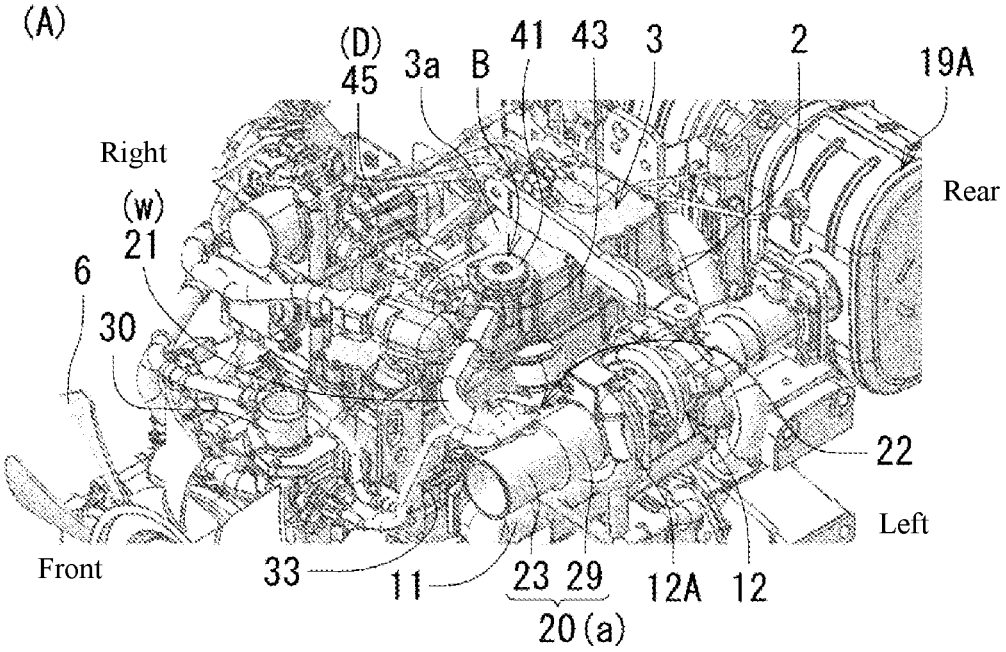
FIG. 4(A) is a perspective view of an upper main part of the engine illustrated in FIG. 1 as viewed from the upper left front side.
FIG. 4(B) is a perspective view illustrating a cooling water supply/discharge portion to/from a cylinder head cover.
Figure 4:
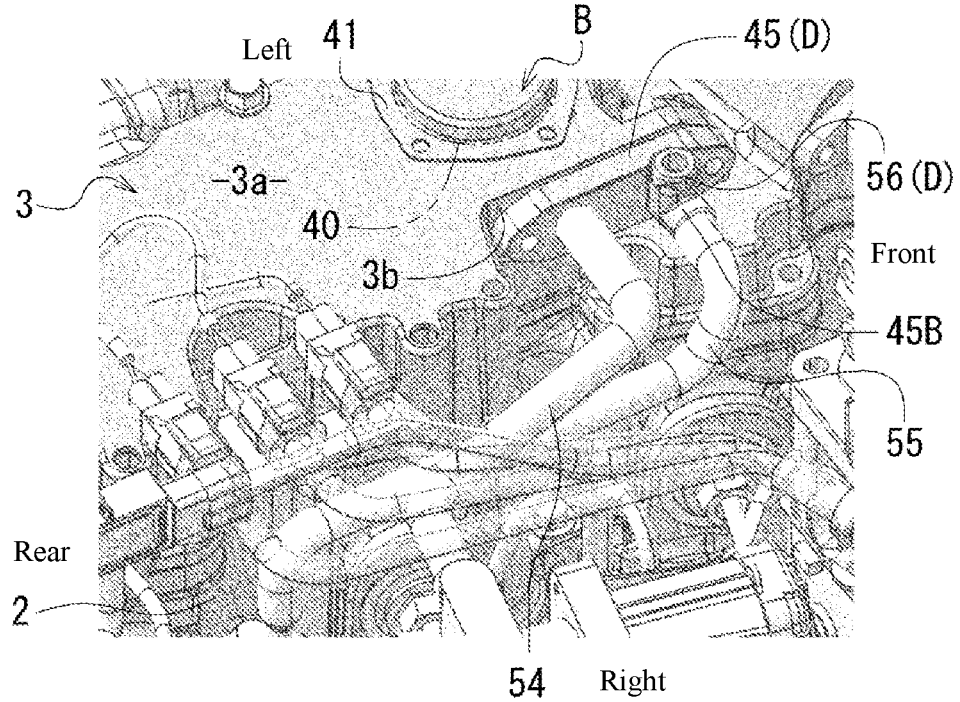
Figure 6:
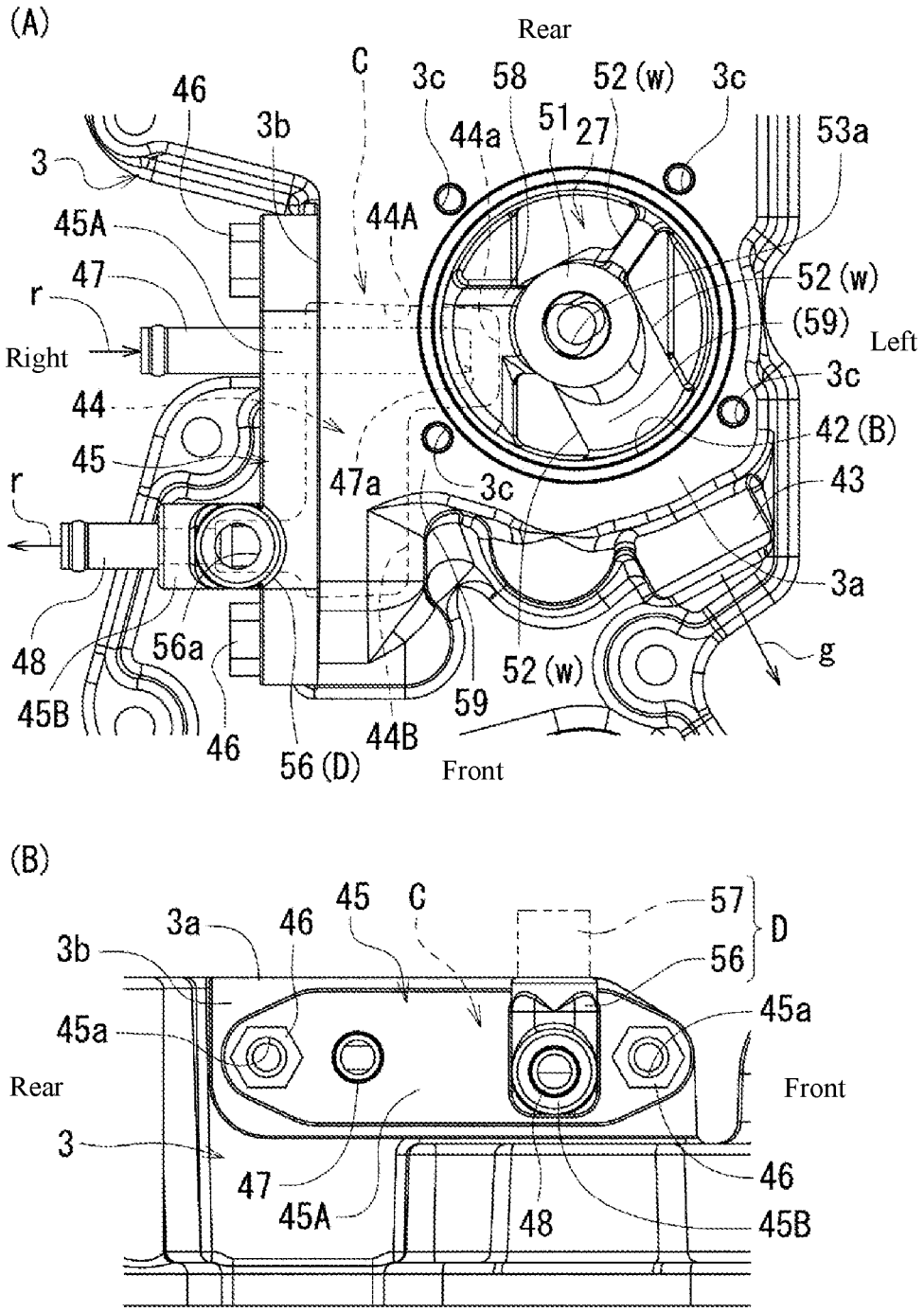
FIG. 6 illustrates a heating mechanism, in which (A) is a plan view of a main part, and (B) is a right side view of the main part.

As illustrated in FIGS. 4 to 6, the PCV valve B acting on the in-cover gas passage 3A is configured in the head cover 3 in a state of using the top wall 3*a* of the head cover 3. As illustrated in FIG. 4(B), the PCV valve B is a diaphragm valve, and a cover lid 41 made of sheet metal material that enables assembly and removal of a diaphragm 40 is detachably attached to the top wall 3*a* of the head cover 3 by screwing or the like. By providing the PCV valve B on the head cover 3 in a state of being exposed to the outside, there is an advantage that maintenance of the inside of the valve (replacement of the diaphragm 40 or the like) can be performed by attaching and detaching the cover lid 41 without removing the head cover 3.

In the blow-by gas passage w of the blow-by gas recirculation device A, the configuration in which the PCV valve B having a diaphragm valve structure (may be referred to as a breather valve) is provided in the head cover 3 is a well-known technique in Japanese Patent Application Laid-Open No. 2006-22650, Japanese Patent Application Laid-Open No. 2004-116395, and the like, and here the structure of the PCV valve B will be described briefly.

The PCV valve B is provided on the top wall 3*a* using a valve installation hole 42 formed in the top wall 3*a*, and the blow-by gas that has passed through the in-cover gas passage 3A and the PCV valve B flows out from the gas outlet portion 43 formed below the valve installation hole 42 in a state of facing left front, and flows to the gas duct 21. That is, the PCV valve B is disposed in the gas outlet portion 43 in a state where most constituent elements thereof are formed on the top wall 3*a* itself. Note that in FIGS. 6(A) and 7, reference numeral 51 denotes an annular valve seat, reference numeral 52 denotes a surrounding space portion communicating with the in-cover gas passage 3A, reference numeral 53 denotes a discharge passage, and reference numeral 53*a* denotes a discharge passage inlet. In addition, a plurality of nut portions 3*c* for bolting the cover lid 41 to the top wall 3*a* are formed near the periphery of the valve installation hole 42.

As illustrated in FIGS. 4 to 7, a temperature raising mechanism C capable of warming the PCV valve B is provided in the head cover 3. The temperature raising mechanism C is configured by forming a flow path 44 for flowing the cooling water r near the PCV valve B on the top wall 3*a* of the head cover 3. The flow path 44 is configured by forming a deep hole (lateral hole) that opens on the right side surface and extends leftward and laterally toward the PCV valve B in a thick width of the top wall 3*a*. The flow path 44 having a deep hole shape includes a deep hole portion 44A that extends laterally (leftward) and deeply in the rear portion of the hole, a shallow hole portion 44B that extends forward from the left-right intermediate portion of the deep hole portion 44A, and an opening portion 44C that is long in the front-rear direction and extends over the opening sides of both the hole portions 44A and 44B. The flow path 44 is formed in a lateral hole having an L shape in plan view (see FIG. 7).

Figure 7:
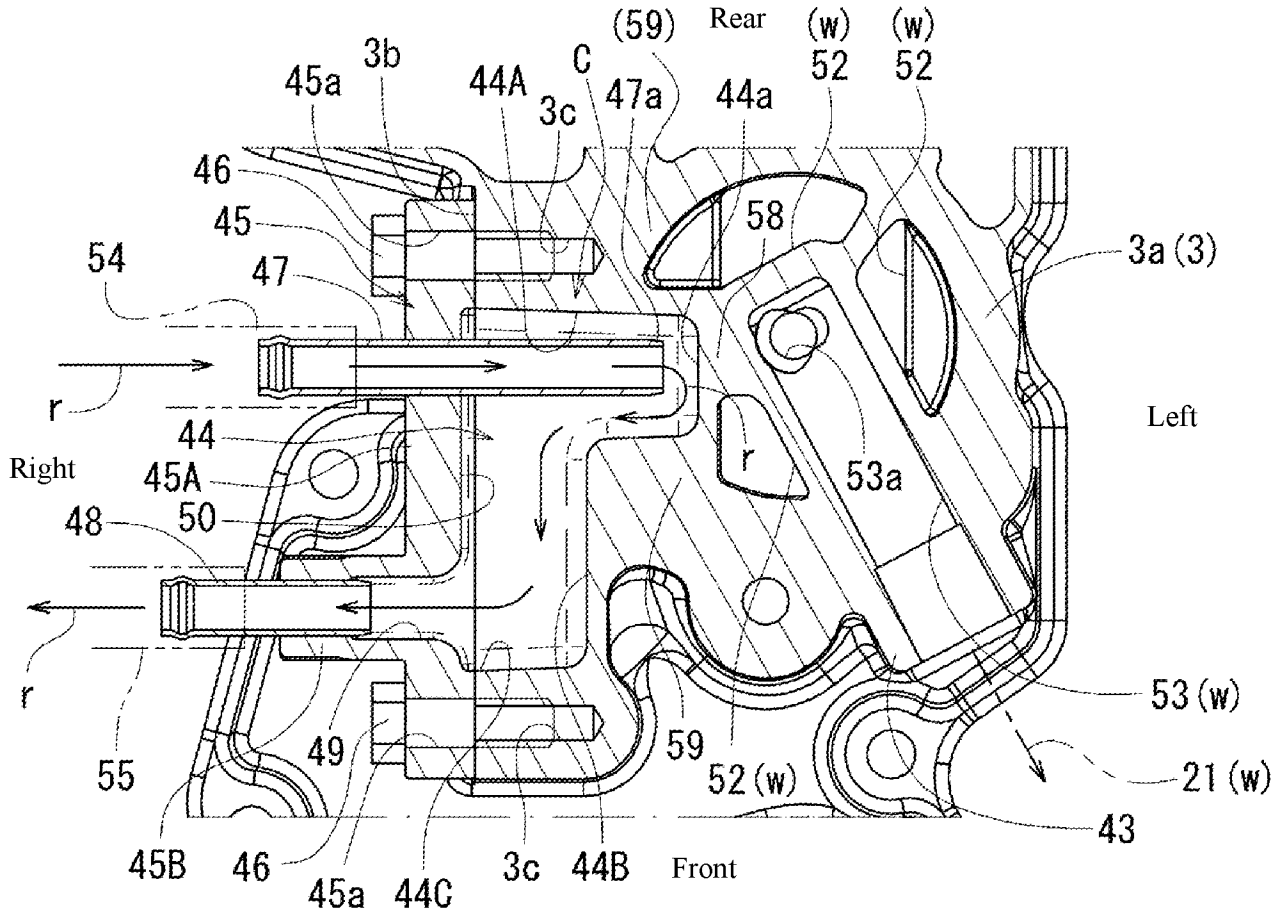
FIG. 7 is a transverse cross-sectional view of a main part illustrating the heating mechanism.

As illustrated in FIGS. 4(B), 6, and 7, a lid body 45 capable of closing the opening portion 44C of the flow path 44 is detachably attached to the head cover 3 by two bolts 46 and 46. The lid body 45 is configured by integrally attaching an inlet pipe 47 and an outlet pipe 48 to a lid body portion 45A, and is liquid-tightly attached to a vertical mounting surface 3*b* formed on the right side of the top wall 3*a* using two mounting holes 45*a* and 45*a* of the lid body portion 45A long in the front-rear direction. A gasket (not illustrated) may be provided between the mounting surface 3*b* and the lid body 45 as necessary.

The inlet pipe 47 is liquid-tightly and penetratingly supported by the rear portion of the lid body portion 45A, and a tip portion 47*a* thereof is provided in a state of having a large insertion amount so as to reach a hole bottom 44*a* portion of the deep hole portion 44A. The outlet pipe 48 is an outlet for a fluid with respect to the deep hole, and is liquid-tightly and internally fitted in an outlet protrusion 45B formed in the front portion of the lid body portion 45A. On the inner surface of the lid body portion 45A, a discharge introduction recess 49 located in the outlet protrusion 45B and a flat recess 50 that is long in the front-rear direction and extremely shallow are continuously formed. When the lid body 45 is assembled to the head cover 3, the discharge introduction recess 49 and the flat recess 50 are configured such that they face the opening portion 44C with substantially the same dimensions.

In the temperature raising mechanism C, the cooling water r enters the hole bottom 44*a* portion of the deep hole portion 44A from the inlet pipe 47, and then flows to the deep hole portion 44A, the shallow hole portion 44B, the discharge introduction recess 49, and the outlet pipe 48. When the cooling water r flows through the flow path 44, the heat of the cooling water r is conducted to a valve structure portion 58 and a surrounding portion 59 of the PCV valve B on the head cover 3, so that the temperature of the PCV valve B can be quickly and efficiently raised. A supply pipe 54 for the cooling water r is connected to the inlet pipe 47, and a discharge pipe 55 is connected to the outlet pipe 48 [see FIG. 4(B)].

With the temperature raising mechanism C, the temperature of the cooling water r is quickly raised with the start of the engine, and the PCV valve B is warmed from the inside by the cooling water r that has become a warm fluid, even if the PCV valve B whose lid body 45 is exposed to the outside freezes in extremely cold weather such as winter. Therefore, the moisture in the blow-by gas is prevented from freezing in the PCV valve B, and the blow-by gas recirculation device A in which the PCV valve B works well can be realized. In addition, the flow path 44 is formed in the head cover 3 itself, so that it is not necessary to provide another dedicated flow path and the temperature raising mechanism C that is economical and space-saving can be realized, and the temperature of the PCV valve B can be quickly and efficiently raised from the valve structure portion 58 that is the central portion thereof.

As illustrated in FIGS. 4(B), 6(A), and 6(B), a base portion 56 for an air bleeding portion (air bleeding) D to act on the blow-by gas passage w is formed in the lid body 45. The air bleeding portion D includes the base portion 56 and a bleeding operation tool 57 attached to the base portion. The base portion 56 is formed in the outlet protrusion 45B in a state of having a vertical hole 56*a* communicating with the discharge introduction recess 49. The bleeding operation tool 57 illustrated in FIG. 6(B) [not illustrated in FIG. 4(B)] is configured by, for example, a screw plug or a union bolt, but is not limited thereto.

Since the PCV valve B and the lid body 45 are located at the highest position in the blow-by gas passage w, there is a merit that air bleeding for the blow-by gas passage w can be performed by one air bleeding portion D provided in the lid body 45. Moreover, the lid body 45 has a reasonable structure that serves as both a constituent member of the temperature raising mechanism C and a main part (base portion 56) of the air bleeding portion D, which is advantageous in terms of cost reduction, size reduction, simplification of configuration, and the like.

Figure 2:
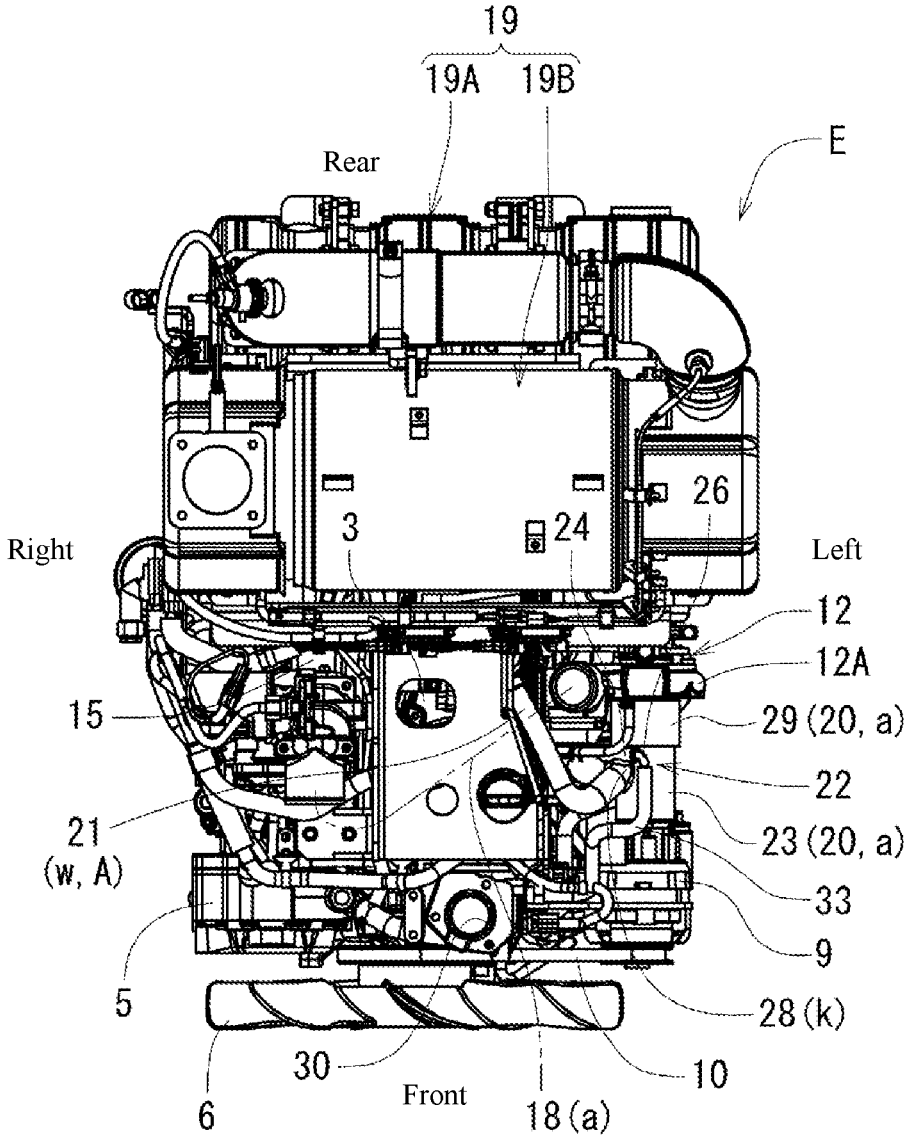
FIG. 2 is a plan view of the engine illustrated in FIG. 1.
Figure 3:
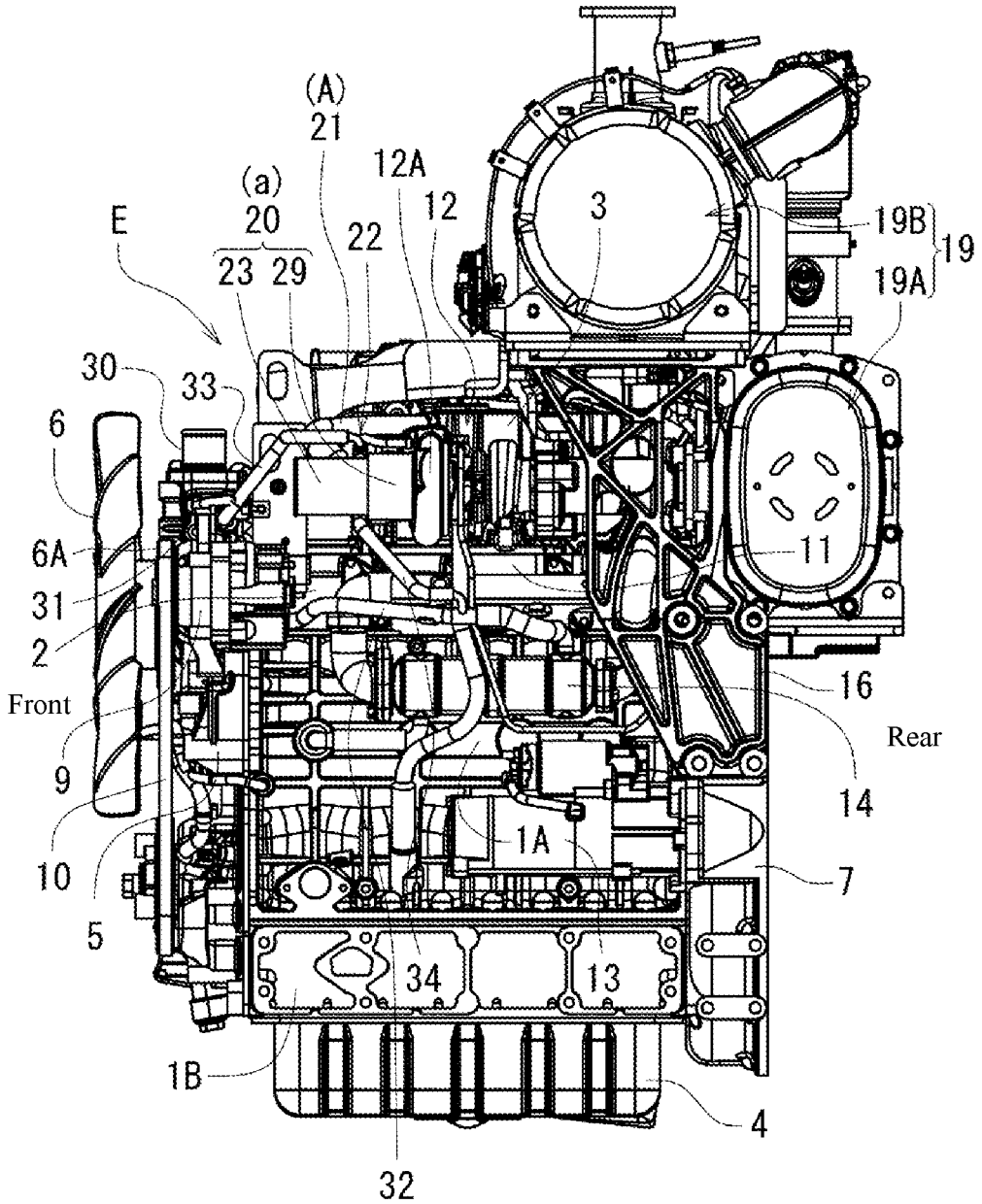
FIG. 3 is a left side view of the engine illustrated in FIG. 1.

As illustrated in FIGS. 1 to 3, a heating mechanism 22 capable of heating a recirculation passage portion k in which the blow-by gas passage w is communicatively connected to the intake passage a is mounted. The recirculation passage portion k is configured as a portion where the inrush pipe 28, which is the terminal portion of the blow-by gas passage w, and the straight pipe 23 (intake passage a) are obliquely and communicatively connected.

The heating mechanism 22 is formed by attaching a pipeline 24 through which the cooling water r passes to the recirculation passage portion k, and a cooling water inlet portion (not illustrated) made of a metal pipe is liquid-tightly provided below the pipeline 24 made of a metal pipe, and a cooling water outlet portion 26 made of a metal pipe is liquid-tightly provided above the pipeline 24. The pipeline 24 is attached in a state of straddling and being in contact with both the straight pipe 23 and the inrush pipe 28 by welding (welding or the like).

A first connection tube 34 that connects a branched pipe (reference sign is omitted) from an EGR cooler cooling water pipe 32 and a cooling water inlet portion (not illustrated) and a second connection tube 33 that connects a water pump 31 and the cooling water outlet portion 26 are provided. For example, the cooling water r enters the pipeline 24 from the cooling water inlet portion on the lower side (not illustrated), is thermally conducted to the recirculation passage portion k when passing through the pipeline 24, and then exits from the cooling water outlet portion 26 on the upper side.

It is possible to obtain an advantage that troubles, in which in extremely cold weather the moisture in the blow-by gas recirculated into the inrush pipe 28 and the straight pipe 23 freezes by being cooled by low-temperature fresh air and the internal passage of the inrush pipe 28 is narrowed or clogged by the freezing, does not occur. The straight pipe 23, the inrush pipe 28, and the pipeline 24 are metal pipes, and the recirculation passage portion k is excellent in thermal conductivity, so that blow-by gas g and cold fresh air can be warmed by the heat of the cooling water r.

Another Embodiment

The oil filter 36 to be installed in the oil separator 25 may have a structure other than the impactor structure.

The pressure regulating valve B may be a valve having a structure other than the diaphragm valve.

DESCRIPTION OF REFERENCE SIGNS

1B: Crankcase
3: Head cover
3A: In-cover gas passage
25: Oil separator
27: Separator outlet
35: Separator inlet
36: Oil filter
36*a*: Nozzle
36*b*: Collision plate
38: Oil dropping portion
39: Check valve
40: Diaphragm
41: Cover lid
B: Pressure regulating valve
F: Valve mechanism
a: Intake passage

The invention claimed is:

1. A blow-by gas recirculation device configured to guide blow-by gas from a crankcase to an intake passage through an in-cover gas passage formed inside a head cover, wherein
   an oil separator that traps and removes oil from the blow-by gas is attached to an inside of the head cover,
   a pressure regulating valve is provided on an outlet side of the in-cover gas passage in the head cover, and
   a separator outlet, which is an outlet for the blow-by gas in the oil separator, is overlapped on a blow-by gas inlet portion of the pressure regulating valve.

2. The blow-by gas recirculation device according to claim 1, wherein the pressure regulating valve is disposed in a gas outlet portion of the in-cover gas passage with respect to the head cover.

3. The blow-by gas recirculation device according to claim 2, wherein the oil separator includes a separator inlet through which the blow-by gas is introduced, an oil filter, an oil dropping portion, and the separator outlet through which the blow-by gas is discharged.

4. The blow-by gas recirculation device according to claim 3, wherein the oil filter has an impactor structure including a nozzle and a collision plate.

5. The blow-by gas recirculation device according to claim 2, wherein the oil separator is formed in a long shape along a longitudinal direction of the head cover.

6. The blow-by gas recirculation device according to claim 1, wherein the pressure regulating valve is a diaphragm valve, and a cover lid that enables assembly and removal of a diaphragm is detachably attached to the cylinder head cover.

7. The blow-by gas recirculation device according to claim 2, wherein the pressure regulating valve is a diaphragm valve, and a cover lid that enables assembly and removal of a diaphragm is detachably attached to the cylinder head cover.

8. The blow-by gas recirculation device according to claim 7, wherein the oil separator includes a separator inlet through which the blow-by gas is introduced, an oil filter, an oil dropping portion, and the separator outlet through which the blow-by gas is discharged.

9. The blow-by gas recirculation device according to claim 8, wherein the oil filter has an impactor structure including a nozzle and a collision plate.

10. The blow-by gas recirculation device according to claim 6, wherein the oil separator includes a separator inlet through which the blow-by gas is introduced, an oil filter, an oil dropping portion, and the separator outlet through which the blow-by gas is discharged.

11. The blow-by gas recirculation device according to claim 10, wherein the oil filter has an impactor structure including a nozzle and a collision plate.

12. The blow-by gas recirculation device according to claim 6, wherein the oil separator is formed in a long shape along a longitudinal direction of the head cover.

13. The blow-by gas recirculation device according to claim 1, wherein the oil separator includes a separator inlet through which the blow-by gas is introduced, an oil filter, an oil dropping portion, and the separator outlet through which the blow-by gas is discharged.

14. The blow-by gas recirculation device according to claim 13, wherein the oil filter has an impactor structure including a nozzle and a collision plate.

15. The blow-by gas recirculation device according to claim 14, wherein the oil dropping portion protrudes toward a gap portion of a valve mechanism provided inside the head cover.

16. The blow-by gas recirculation device according to claim 14, wherein a check valve that allows a downward movement of the oil and prevents an upward movement of the oil is provided in a lower end portion of the oil dropping portion.

17. The blow-by gas recirculation device according to claim 13, wherein the oil dropping portion protrudes toward a gap portion of a valve mechanism provided inside the head cover.

18. The blow-by gas recirculation device according to claim 17, wherein a check valve that allows a downward movement of the oil and prevents an upward movement of the oil is provided in a lower end portion of the oil dropping portion.

19. The blow-by gas recirculation device according to claim 13, wherein a check valve that allows a downward movement of the oil and prevents an upward movement of the oil is provided in a lower end portion of the oil dropping portion.

20. The blow-by gas recirculation device according to claim 1, wherein the oil separator is formed in a long shape along a longitudinal direction of the head cover.

* * * * *